US008800419B1

(12) United States Patent
Walker

(10) Patent No.: US 8,800,419 B1
(45) Date of Patent: Aug. 12, 2014

(54) COMPENSATOR WITH THRUST SURFACES

(71) Applicant: Drew Nolle Walker, Mesa, AZ (US)

(72) Inventor: Drew Nolle Walker, Mesa, AZ (US)

( * ) Notice: Subject to any disclaimer, the term of this patent is extended or adjusted under 35 U.S.C. 154(b) by 15 days.

(21) Appl. No.: 13/623,878

(22) Filed: Sep. 21, 2012

Related U.S. Application Data

(60) Provisional application No. 61/537,061, filed on Sep. 21, 2011.

(51) Int. Cl.
*F41A 21/36* (2006.01)

(52) U.S. Cl.
USPC ..... 89/14.3

(58) Field of Classification Search
CPC ..... F41A 21/36; F41A 21/30; F41A 21/34
USPC ..... 89/14.3, 14.6, 1.41, 14.05, 14.2, 14.7; 42/107; 124/81
See application file for complete search history.

(56) References Cited

U.S. PATENT DOCUMENTS

| | | | | | |
|---|---|---|---|---|---|
| 817,134 | A | * | 4/1906 | Smith | 89/14.3 |
| D158,796 | S | * | 5/1950 | Powell | D22/108 |
| 4,436,017 | A | * | 3/1984 | Mohlin | 89/14.3 |
| 4,852,460 | A | | 8/1989 | Davidson | |
| 5,123,328 | A | | 6/1992 | Schuemann | |
| 5,367,940 | A | * | 11/1994 | Taylor | 89/14.3 |
| 5,476,028 | A | * | 12/1995 | Seberger | 89/14.3 |
| 5,685,102 | A | * | 11/1997 | Latka | 42/85 |
| 5,753,846 | A | | 5/1998 | Koon | |
| 6,269,727 | B1 | * | 8/2001 | Nigge | 89/14.3 |
| 6,578,462 | B1 | | 6/2003 | Franchino et al. | |
| 6,595,099 | B1 | | 7/2003 | Olson et al. | |
| 7,032,339 | B1 | * | 4/2006 | Bounds | 42/1.06 |
| 7,194,836 | B1 | * | 3/2007 | Urban | 42/60 |
| 7,296,505 | B2 | * | 11/2007 | Balbo et al. | 89/14.3 |
| 7,836,809 | B2 | | 11/2010 | Noveske | |
| 8,087,337 | B1 | | 1/2012 | Cary | |
| 8,112,931 | B2 | * | 2/2012 | Yost et al. | 42/79 |
| 8,424,440 | B1 | * | 4/2013 | Carson et al. | 89/14.3 |

* cited by examiner

*Primary Examiner* — Samir Abdosh
*Assistant Examiner* — John D Cooper
(74) *Attorney, Agent, or Firm* — Lerner, David, Littenberg, Krumholz & Mentlik, LLP

(57) ABSTRACT

A firearm compensator, utilizing an expansion chamber affixed to a gun muzzle with an internal volume beneath the barrel's center line containing a curved surface also lying beneath the barrel's center line facing the barrel, is provided. A compression ramp connects the gun muzzle of the expansion chamber to the curved surface. Upon the firing of the gun, gasses enter the expansion chamber, thrust against the compression ramp and into the curved surface. This curved surface catches expanding gasses like a sail thereby reducing muzzle rise and rearward recoil. A plurality of exhaust ports vent the expanding gasses out of the expansion chamber and out of the shooter's field of view.

19 Claims, 10 Drawing Sheets

COMPENSATOR WITH THRUST SURFACES

CROSS-REFERENCE TO RELATED PATENT APPLICATIONS

This application claims the benefit of provisional patent application Ser. No. 61/537,061 filed 2011 Sep. 21 by the present inventor.

BACKGROUND

Prior Art

The following is a tabulation of some prior art that presently appears relevant:

US Patents:

| Pat. No. | Issue Date | Patentee |
|---|---|---|
| 5,123,328 | Jun. 23, 1992 | Scheumann |
| 5,753,846 | May 19, 1998 | Koon |
| 8,087,337 | Jan. 03, 2012 | Cary |
| 4,852,460 | Aug. 01, 1989 | Davidson |
| 7,836,809 | Nov. 23, 2010 | Noveske |
| 6,595,099 | Jun. 22, 2003 | Olson et al. |
| 6,578,462 | Jun. 17, 2003 | Franchino et al. |
| 5,476,028 | Dec. 19, 1995 | Seberger |

The arms industry has seen many compensators for firearm designs over the years and their design shortfalls have either been consistently ignored or they remain unrecognized. The traditional approach to reducing recoil and muzzle climb subsequent to firing has been to employ compensators that port jets of gasses vertically upward which applies a downward force on the muzzle, or through expansion chambers wherein gasses thrust against baffle-like structure which applies a forward force to the weapon that lessens rearward recoil. While vertical porting is somewhat effective in its own right, it produces a bright vertical flash that is highly undesirable for tactical applications and all low-light usage. Porting jets of gasses upward does not yield a dramatic reduction in muzzle climb and does nothing to address rearward recoil experienced by the shooter. Furthermore, expansion chamber designs only directly address the rearward recoil vector, often vent gasses laterally outward and increase muzzle flash, and frequently receive criticism of making the firearm louder when shooting for the shooter.

Vertical porting in a series, as proposed in U.S. Pat. No. 5,123,328 (1992) to Schuemann, demonstrates a common means to compensating firearms. As I have learned via experimentation, porting in a series demonstrates the most impressive jet of gasses and downward thrust at the first port approached by the expanding gasses and all sequential ports exhibit a lesser display of both the upward-shooting jet as well as the total generated downward thrust. In terms of the thrust that vertical porting produces, I have found it to be a short and arguably inconsequential burst that does not produce enough to significantly counteract muzzle rise. To define terminology more precisely, a firearm's recoil should be viewed in terms of its vectors. These recoil vectors are vertical (resulting in muzzle climb) and rearward (resulting in a weapon's "kick" into the shooter's shoulder). Vertical porting addresses only one of these vectors directly.

Compensators that use thrust surfaces inside of expansion chambers or baffles (or baffle-like structures as seen on the iconic AK-74 muzzle break), often seen on tanks and rifles, address the rearward recoil vector and do nothing to address vertical recoil vector directly. U.S. Pat. No. 5,753,846 (1998) to Koon demonstrates the basic thrust surface principle in which expanding gasses exit the firearm, enter the expansion chamber, and thrust against a surface facing the firearms muzzle before exiting the expansion chamber much like gasses thrusting against baffles in a firearm suppressor. The resulting force from the gasses thrusting against this surface directly opposes the rearward recoil vector. This force lowers recoil along the rearward vector, and, as a result of firearm barrels being positioned above the weapon's center of gravity, it also lowers recoil along the vertical vector somewhat, albeit to a much smaller extent. Anyone with experience with fully automatic firearms compensated with a basic thrust surface design can attest to the highly undesirable vertical muzzle climb. Compensators employing traditional expansion chambers using baffles or thrust surfaces offer an incomplete solution in terms of directly addressing both vectors of recoil.

Additional expansion chamber compensator designs demonstrated in U.S. Pat. No. 7,836,809 to Noveske (2010), U.S. Pat. No. 6,578,462 to Franchino (2003), and U.S. Pat. No. 6,595,099 (2003) to Olson et al. aim to hide muzzle flash while also reducing rearward recoil. These designs disperse muzzle flash via radial, birdcage-style vents (e.g. Franchino's design), forward-facing slots machined into the end of the expansion chamber (e.g. the design by Olson et al.), or, a conical fixture that restricts the expansion of the outgoing gasses (e.g. Noveske's design). Each of these respective designs presents an ineffective solution because they address directly only the rearward recoil vector.

The previously mentioned designs of Noveske, Franchino, and Olson et al. all lose a portion of the pressure from the incoming expanding gasses due to the manner in which these designs attempt to hide muzzle flash; each design fails to consider the dynamics of the gasses rushing through a barrel upon a firearm's discharge. Stated briefly, these gasses are supersonic, very hot, and exhibit turbulent, unsteady flow for an extremely short period of time. That said, it is essential to note that in light of the unsteady flow and the extremely expansive nature of the gases, compensators using thrust surfaces need to utilize compression for maximum effectiveness in the production of generating counter-recoil forces. The birdcage design demonstrated in Franchino's patent allows for gasses to almost immediately disperse. The internal volume of the Noveske design's expansion chamber grabs only a fraction of the expanding gasses for its thrust surface; the majority of the gasses continue onto the conical portion which acts like a rocket nozzle, arguably adding to the rearward recoil vector and cannibalizing the effectiveness of its thrust surface. Lastly, the Olson et al. design actually reduces the surface area of the expansion chamber used to engage the expanding gasses by machining slots for flash hiding purposes; physically reducing the thrust surface area is a design flaw that reduces the device's recoil reduction capacity considerably. Furthermore in the case of the occasional errant projectile striking the thrust surface, the slots offer no engineered point of failure.

In an effort to directly address both vectors of recoil, U.S. Pat. No. 4,852,460 to Davidson (1989) uses a hybrid approach of both an expansion chamber with a thrust surface and vertical porting (whose ports are aiming upwards at 45 degrees from being completely vertical, forming a V-pattern); this combines the worst of both approaches. A muzzle flash spreads out within the shooter's direct field-of-view while the porting offers little actual vertical muzzle climb resistance. The expansion chamber loses compression due to the vertical V-pattern ports and contributes even less to counteracting rearward recoil.

Another hybrid design, as demonstrated by U.S. Pat. No. 8,087,337 to Cary (2012), uses a series of small expansion chambers surrounded by vertical and horizontal porting. The gasses thrust against the series of baffles (for the sake of defined terminology, this should be synonymous with "thrust surfaces") and exit via the compensator's porting as well as at its muzzle. Porting in series experiences diminished effectiveness with each successive port; this principle of diminished sequential results also applies to thrust surfaces. Due to Cary's sequential baffle and porting design, pressure is lost very quickly as much more high-pressure gasses strike against the first baffle when compared to each successive baffle. Furthermore, the radial porting design which surrounds the vertical and horizontal sides of the compensator only serves to directly address the horizontal recoil vector through diffusing the overall blast exiting the firearm. While this design may have some flash suppression value, as well as some effectiveness at reducing overall recoil, the design works against itself.

Lastly, U.S. Pat. No. 5,476,028 to Seberger (1995) utilizes an expansion chamber with a concave thrust surface that cradles the incoming blast from expanding gasses along with both vertical and horizontal porting. The concave thrust surface is limited in that there are no means of compression against this surface. Seberger's concave surface is positioned incorrectly relative to the barrel's centerline. Seberger's concave surface shaped from a spherical segment tilted away from a radial axis normal to the barrel's center line results in an inefficient thrust surface. A concave thrust surface should be positioned vertically beneath the barrel's center line to aggressively engage expanding gasses. While Seberger claims his design is made to "neutralize axial and both vertical and horizontal recoil", the design makes use of vertical, radial, and horizontal porting (and uses such porting in sequence in some embodiments) which lowers expansion chamber compression and negates its use for tactical and low-light applications. The concave surface(s) in Seberger's design embodiments are engineered to strike the baffling (i.e. thrust surface) surface, generate a forward force and reflect the blast of the incoming gasses into the compensator's ports. Furthermore the baffling surface is positioned close to the gun muzzle. Seberger's design fails to utilize a means of guiding and further compressing the gasses into a curved thrust surface with ample surface area (one that is approximately curved and positioned vertically beneath the barrel's axis) meant to directly address horizontal and vertical recoil while avoiding a blinding vertical muzzle flash, thereby allowing for tactical applications.

A need remains for a compensator using focused compression and thrust surfaces to directly and simultaneously address both vertical muzzle rise and rearward recoil. Furthermore, a need remains for a compensator that readily allows the compensator design to become a viable option for combat operations on all manners of firearms during low light conditions.

SUMMARY

Briefly described, the present invention provides a recoil-reducing device in front of the muzzle of the firearm. It is an aspect of this invention to provide a highly effective compensating apparatus and method that effectively counters both muzzle climb and rearward recoil while avoiding a vertical muzzle flash in the shooter's direct field of view (i.e. above the firearm's muzzle) utilizing thrust surfaces and compression.

The present invention's expansion chamber positioned in front of the muzzle utilizes a curved surface beneath the barrel's centerline axis used to provide a large surface area that grabs gasses much like a sail on a boat (these gas-grabbing surfaces hereafter referred to as 'thrust surface'). A compression ramp connects the beginning of the expansion chamber where gasses first enter to the curved thrust surface; this compression ramp guides and compresses downward-expanding gasses into the curved surface. The compression ramp acts as a thrust surface in that it generates a downward force that combats muzzle rise while also amplifying the counter-recoil forces generated by focused gasses striking the curved thrust surface. The curved thrust surface utilizes the mass and energy of the gasses expelled by a fired cartridge to then counteract the muzzle climb by producing a counter-rotational force. In another embodiment, the expansion chamber's curved thrust surface features beveled curves, dimples, or ridges (all of which are included in the term 'surface indents' later used) that increase the thrust surfaces' total area so as to enhance the gas-grabbing effect and therefore the produced counter-recoil force. In its preferred embodiment, the gasses are then vented out exhaust ports located on the sides or on the curved thrust surface itself producing an exhaust jet that avoids the shooter's immediate field of view.

It is another aspect of the invention to reduce muzzle flash. The bore of the compensator (later referred to as the 'departure recess') that allows the bullet to exit the device may use shapes other than a plain circle such as a gear-like, serrated shape to mimic the effects of a "birdcage" style flash hider. This gear-like, serrated shape for the bore of the compensator also provides an engineered, controlled failure point; instead of a projectile striking the inside of the expansion chamber and causing massive damage to the firearm as well as the shooter, the gear-like pattern forces a slightly stray projectile to chip off a "gear" tooth, thereby minimizing the damage caused. In terms of vertical positioning, the exhaust ports are positioned beneath the barrel's level so that the gasses may exit the invention below the shooter's field of view. Ports may vent gasses straight through ports drilled directly into the thrust surfaces themselves, or a combination thereof. In its preferred embodiment, the invention's exhaust ports are located vertically beneath the center-line of the barrel and horizontally as close to the thrust surface of the expansion chamber as possible, thereby allowing pressure to build because ports would not be used in sequence.

It is another aspect of this invention to address the practical disadvantages of muzzle attachments in general. In another embodiment, this invention incorporates a means of attachment to quick-attach muzzle accessories (e.g. a compensator, muzzle break, or flash hider designed to mount another device on top of itself) on the end of a firearm. Muzzle devices can prohibit the attachment of a bayonet and block the use of a firearm's picatinny-style rails or handgun subframe rails. The device, in its optional embodiments, can, depending on the model type (whether used for a handgun, shotgun, rifle, etc.) incorporate an additional section of railing for mounting peripheral attachments.

It is another aspect of this invention to allow for the usage of the present invention to adapt to a firearm using expanding shot or sabot projectiles. In another embodiment, the compensator uses a porous guide tube that allows gasses to engage the compression ramp and curved thrust surface while restricting the expansion of the shot or sabot passing through the expansion chamber.

In another embodiment, the invention utilizes specially shaped ports that utilize the back-pressure generating when striking a curved thrust surface below a barrel's centerline in the like a pealess whistle, thereby alleviating back-pressure and creating a distinct sound when firing.

DRAWINGS

Figures

Figure 1:
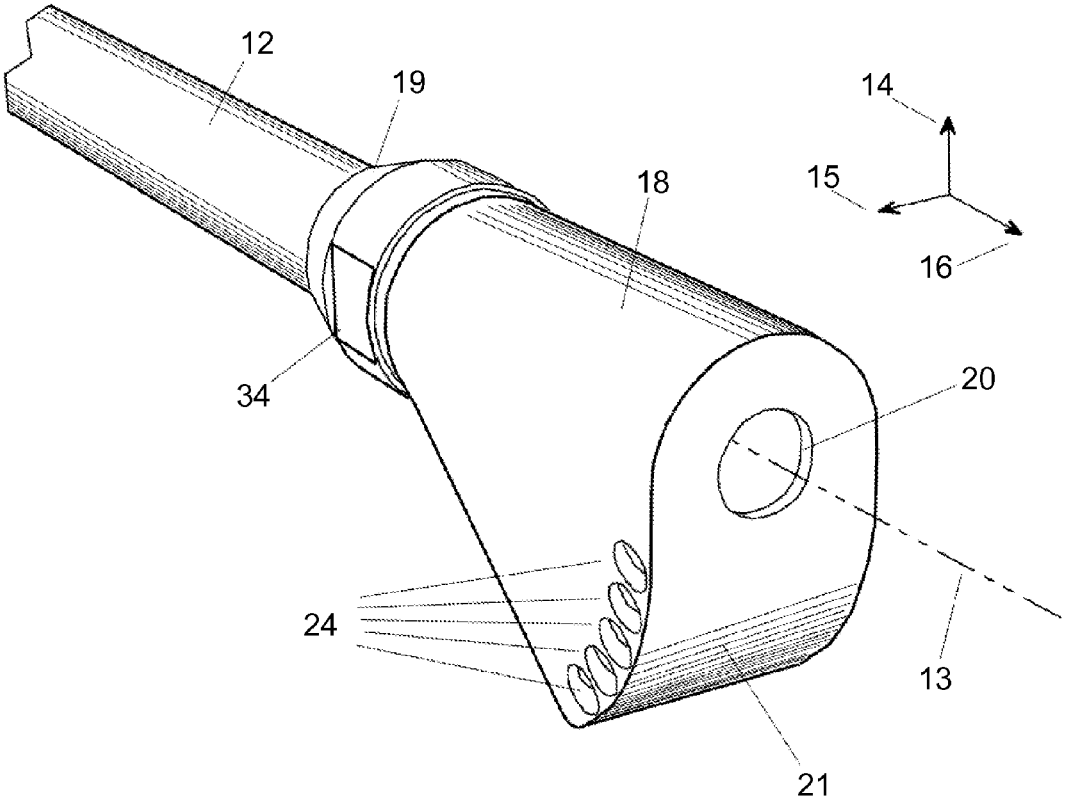
FIG. 1 shows a perspective view of the compensator affixed to the end of a gun barrel.

| DRAWINGS - REFERENCE NUMERALS | |
|---|---|
| 12 | gun barrel |
| 13 | barrel axis |
| 14 | vertical axis |
| 15 | lateral axis |
| 16 | longitudinal axis |
| 17 | gun muzzle |
| 18 | expansion chamber |
| 19 | muzzle engagement recess |
| 20 | departure recess |
| 21 | curved thrust surface |
| 22 | compression ramp |
| 23 | porous guide tube |
| 24 | exhaust ports |
| 25 | surface indents |
| 26 | serrated, gear-shaped pattern |
| 27 | threads |
| 28 | accessory-mounting rails |
| 29 | handgun |
| 30 | quick-attach muzzle accessory |
| 31 | triangular ports |
| 32 | projectile |
| 33 | shot (with sabot) |
| 34 | relief cut |
| 35 | subframe rails |
| 36 | rail engagement area |
| 37 | longitudinally-forward exhaust ports |
| 38 | slot ports |
| 39 | muzzle accessory grooves |
| 40 | engagement grooves |

DETAILED DESCRIPTION OF THE INVENTION'S EMBODIMENTS

In FIG. 1, a gun barrel 12 having an axis 13 down the barrel's centerline is depicted at a perspective view. This embodiment of the compensator is affixed to the gun barrel 12 along its axis 13 via its muzzle engagement recess 19; the compensator is a coaxial extension of the gun barrel along the barrel's centerline axis. To assist in describing the gun attachment, an axes system is defined whereby the arrow at 14 indicates the vertical axis, the arrow at 15 indicates a lateral axis, and the arrow at 16 indicates a longitudinal axis. As for a means of attachment, in this embodiment the compensator's muzzle engagement recess 19 attaches to the gun barrel 12 by means of the barrel's threading (not shown) with the help of a relief cuts 34 on the lateral sides of the compensator to interface with a wrench.

Upon firing, a projectile (not shown) travels along the barrel's axis 13 and exits the compensator at the departure recess 20. Expanding gasses (not shown) fill the expansion chamber 18 and strike against the curved thrust surface 21, producing a counter-recoil force along two vectors, before exiting via the exhaust ports 24 and the departure recess 20.

Figure 2:
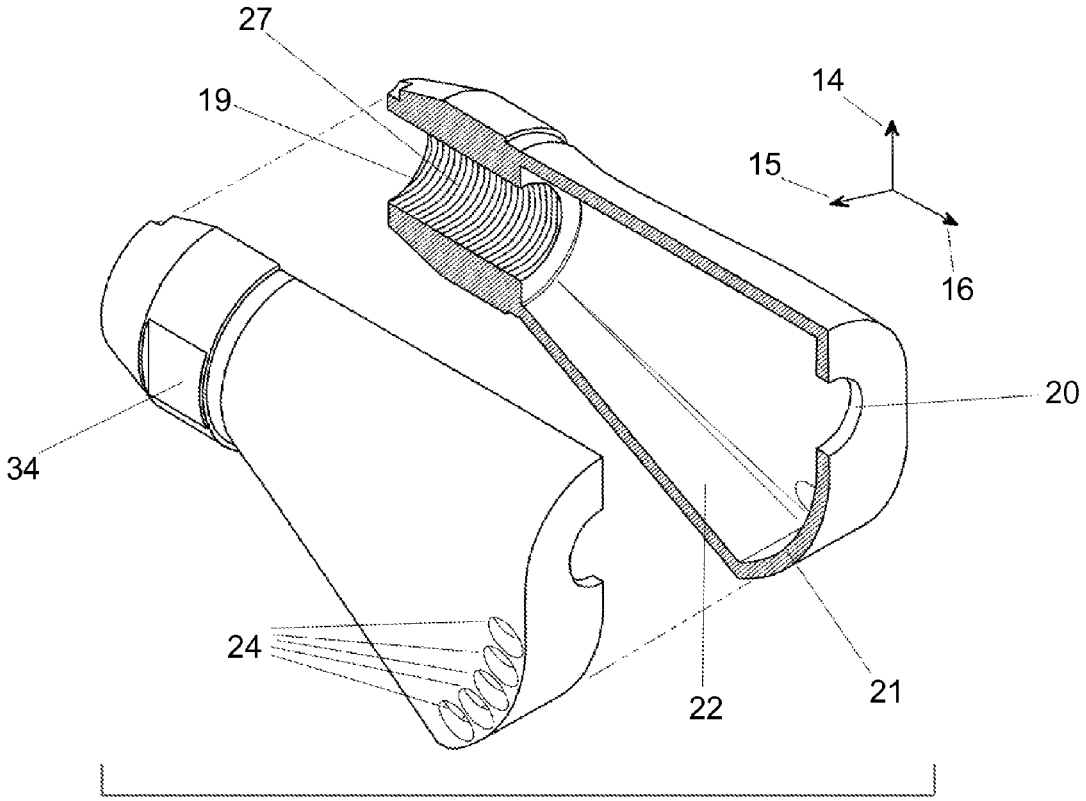
FIG. 2 shows an exploded view of the compensator.

In FIG. 2, the compensator embodiment from FIG. 1 is depicted alone in an exploded view as two halves. From this view, the threading 27 of the muzzle engagement recess 19 is visible. The inner workings of the expansion chamber 18 are now exposed. In it's preferred embodiment, the internal volume of the expansion chamber 18 that lies beneath the barrel's centerline axis 13 may be several times greater than the volume of the projectile (not shown) for which the compensator is designed. The expansion chamber's interior, now visible, makes use of a compression ramp 22 that begins at the vertical bottom of the muzzle engagement recess and extends longitudinally forward to meet the expansion chamber's curved thrust surface 21. The compression ramp 22, which is itself a thrust surface providing a downward-thrust that counters muzzle rise, controls the downward expansion of expanding gasses and guides these gasses along a direct route to the curved thrust surface 21 positioned vertically beneath the departure recess 20. Exhaust ports 24 line the lateral sides closest to the curved inner thrust surface 21 to allow for expanding gasses to build pressure as they approach this surface 21 only to disperse once striking it. From an engineering perspective, the view in FIG. 2 demonstrates the simplest means of manufacturing. In its preferred means of manufacturing, two clam-shell halves machined according to a three dimensional model would be welded together after adding a chamfer where the two halves meet so as to provide as much structural integrity as possible. Acceptable materials for construction may include steel, aluminum, tungsten, titanium, and their respective alloys; each material may be used in conjunction with coatings and surface treatments such as black oxide, nickel-plating, bluing, anodizing, chrome-plating, and ceramic coating.

Figure 3:
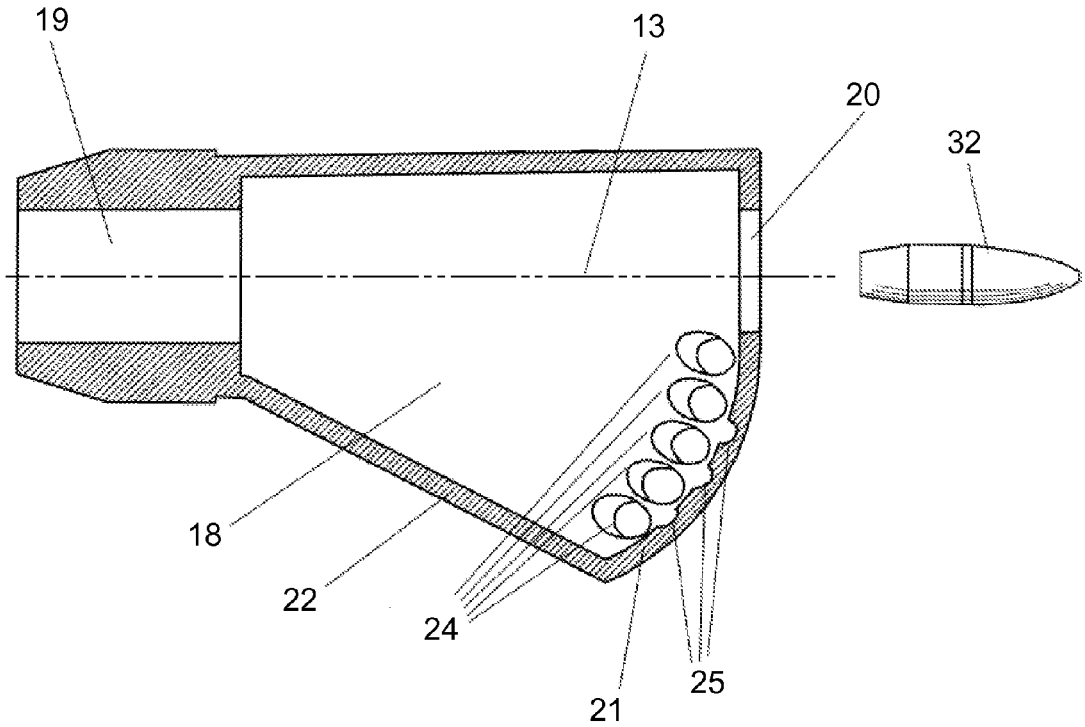
FIG. 3 shows a sectional view of the compensator.

In FIG. 3, a sectional view of the compensator is shown normal to the lateral side of the expansion chamber 18. The barrel's centerline axis 13 is shown to provide a frame of reference. A projectile 32 is depicted passing through the expansion chamber 18 along the axis 13 and has exited via the departure recess 20. FIG. 3 depicts the compression ramp 22 and the curved thrust surface 21 relative to the vertical levels of the barrel's axis 13, the departure recess 20, and the muzzle engagement recess 19.

Furthermore, FIG. 3 depicts the exhaust ports' 24 close proximity relative along the curved thrust surface 21. From this sectional view, the shape of the curved thrust surface 21 within the expansion chamber 18 is approximately concave and begins beneath the barrel's centerline axis 13. While the muzzle engagement recess 19 is simplified in this figure as to not a detailed means of attachment to a gun barrel 12 (not shown), the curved thrust surface 21 depicts surface indents 25, which may be take the form of beveled curves, dimples or ridges facing the muzzle engagement area that enlarge the total surface area of the curved thrust surface 21, thereby increasing the counter recoil force produced when expanding gasses thrust up against it.

Figure 4:
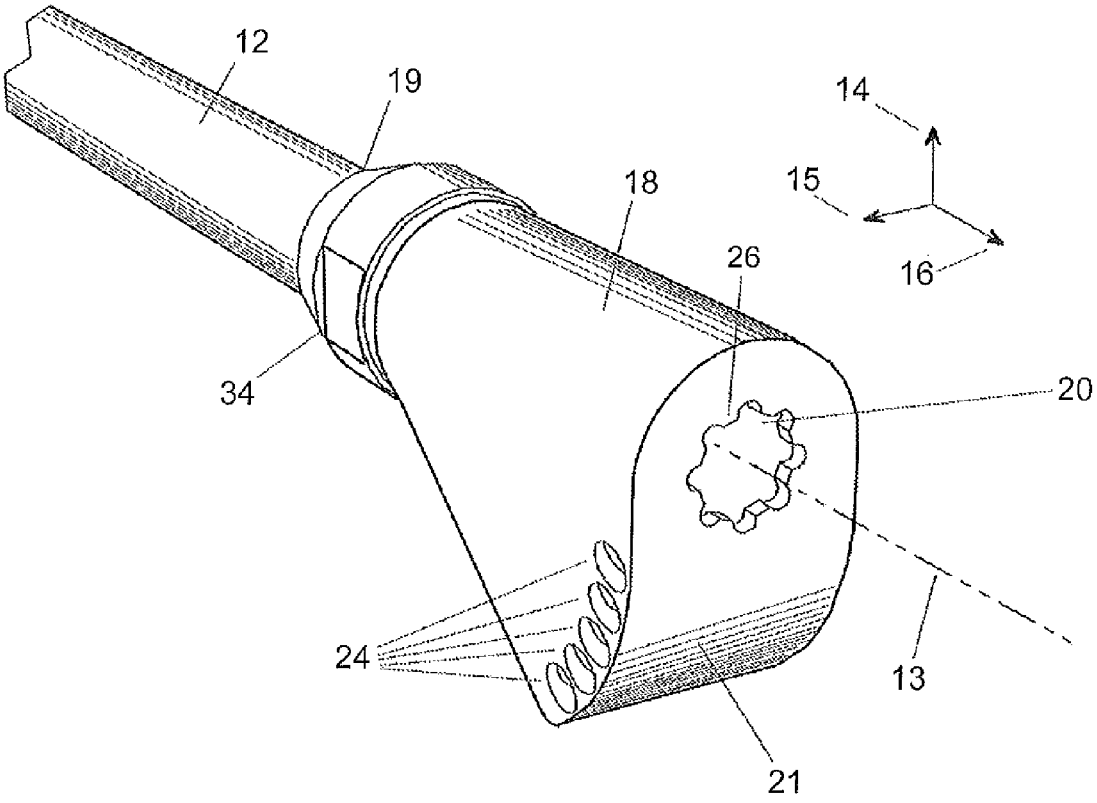
FIG. 4 shows a perspective view of the compensator in FIG. 1 with a modified departure recess.

FIG. 4 depicts a perspective view of an embodiment of the compensator attached to a gun barrel 12 at the same angle seen in FIG. 1. This embodiment contains is the preferred embodiment for a rifle and contains a modified departure recess 20 whose shape is a serrated, gear-shaped pattern 26. This serrated, gear-shaped pattern achieves two significant things: it helps disperse muzzle flash and it creates a controlled, engineered point of failure. This pattern 26 breaks up the expanding gasses' plume (not shown) as it exits through the departure recess 20 thereby reducing muzzle flash. A serrated edge 26 of the departure recess 20 would chip off should an errant, unstable projectile (not shown) depart from the barrel axis 13 and strike the edge of the departure recess 20, thereby minimizing the damage to the compensator.

Figure 5:
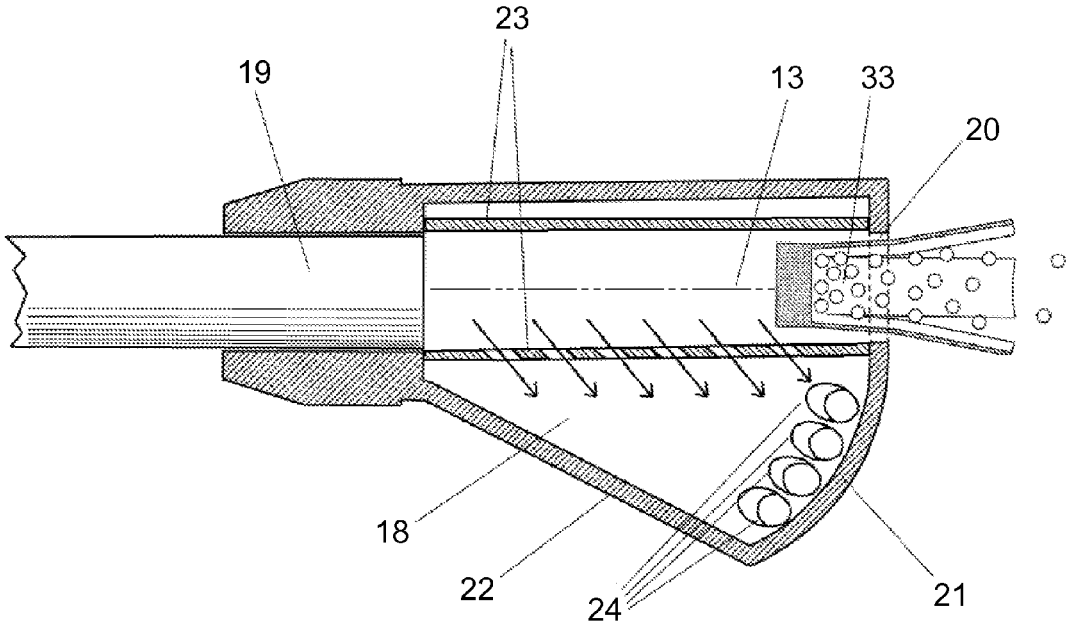
FIG. 5 shows a sectional view of an embodiment of the compensator in FIG. 1 modified for use on a shotgun.

FIG. 5 depicts a sectional view of an alternate embodiment of the compensator as adapted to fit a shotgun. A barrel 12 attaches to the muzzle engagement recess 19 and a porous guide tube 23 joins the muzzle engagement recess 19 with the departure recess 20 along the barrel's axis 13. The porous guide tube 23 restricts the expansion of sabots containing shot 33 until they pass through the departure recess 20 and exit the compensator while allowing gasses to expand through the guide tube 23, pass along the compression ramp 22, and strike the curved thrust surface 21 of the expansion chamber 18.

Figure 6:
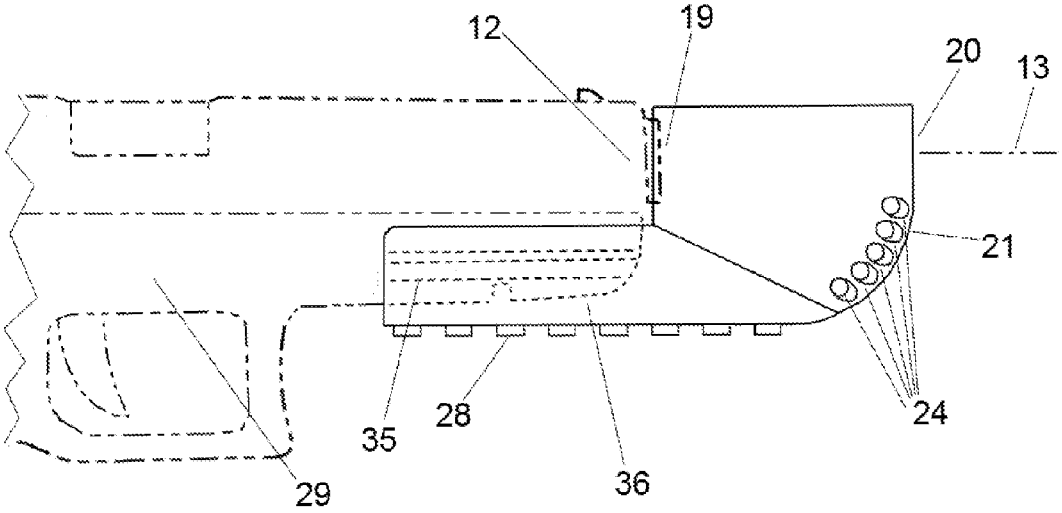
FIG. 6 shows a normal view of an embodiment of the compensator in FIG. 1 modified for use on a handgun.

FIG. 6 depicts an alternative embodiment of the compensator as adapted for use on a handgun 29 with subframe rails 35. The compensator's muzzle engagement recess 19 rests in front of the barrel 12 of the handgun 29. The rail engagement area 36 grips the subframe rails 35 just as any traditional rail accessory does and orientates the expansion chamber's muzzle engagement area 19 and departure recess 20 along the barrel's axis 13. Since the subframe rails 35 are now occupied, accessory mounting rails 28 are located on the vertical bottom of the rail engagement area 36.

Figure 7:
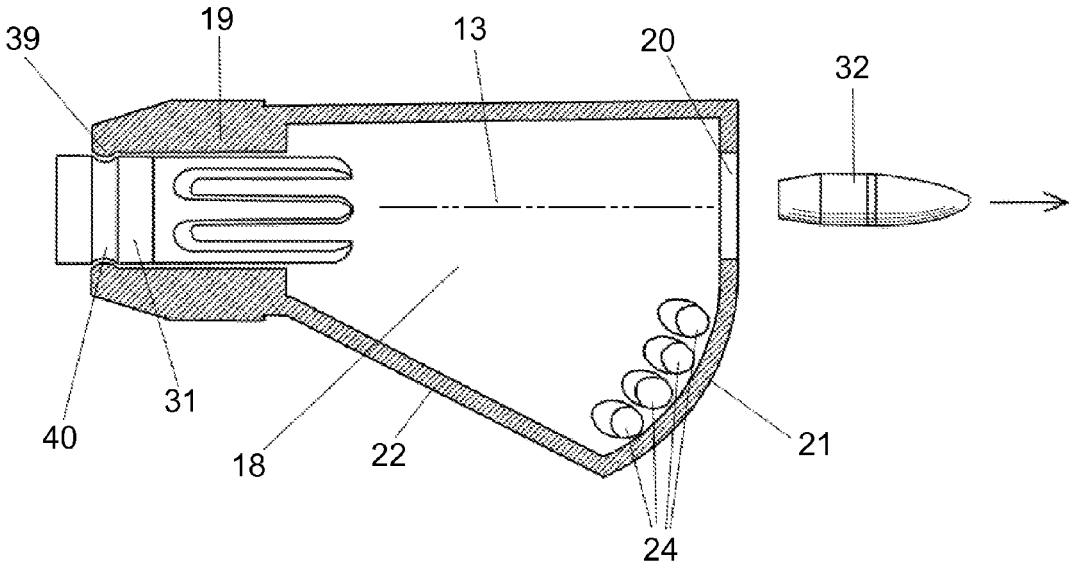
FIG. 7 shows a sectional view of an embodiment of the compensator in FIG. 1 modified for use on a quick-attach flash muzzle accessory.

FIG. 7 shows a sectional view of an embodiment of the compensator as adapted for use over the end of a quick-attach muzzle accessory 31. Many suppressors (not shown) utilize a faster means of attachment than being directly threaded to a barrel by engaging slots or grooves of a flash-hider or compensator. In this embodiment of the compensator, engagement grooves 39 in the muzzle engagement recess 19 grip the grooves 40 of a quick-attach muzzle accessory 31 in a way that orientates the muzzle engagement recess with the barrel 12 (not shown) and departure recess 20 such that a projectile 32 passes along the barrel's axis 13.

Figure 8:
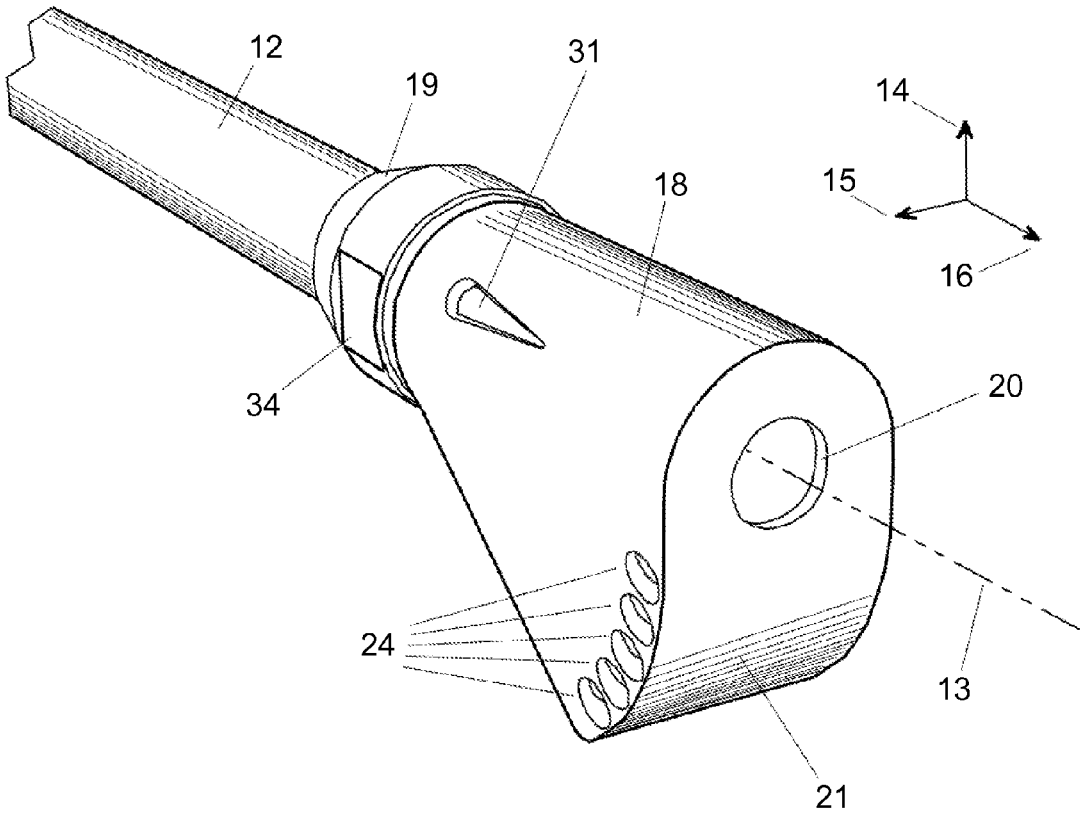
FIG. 8 shows an embodiment of the compensator in FIG. 1 modified with triangular porting.

FIG. 8 depicts an embodiment of the compensator as depicted in FIG. 1 wherein triangular ports 31 like that of a pealess whistle are machined into the lateral sides of the expansion chamber 18. Upon firing, some expanding gasses that strike the curved thrust surface 21 may travel back up the compression ramp 22 and exit the compensator through the triangular ports 31 creating a distinctive pitch.

Figure 9:
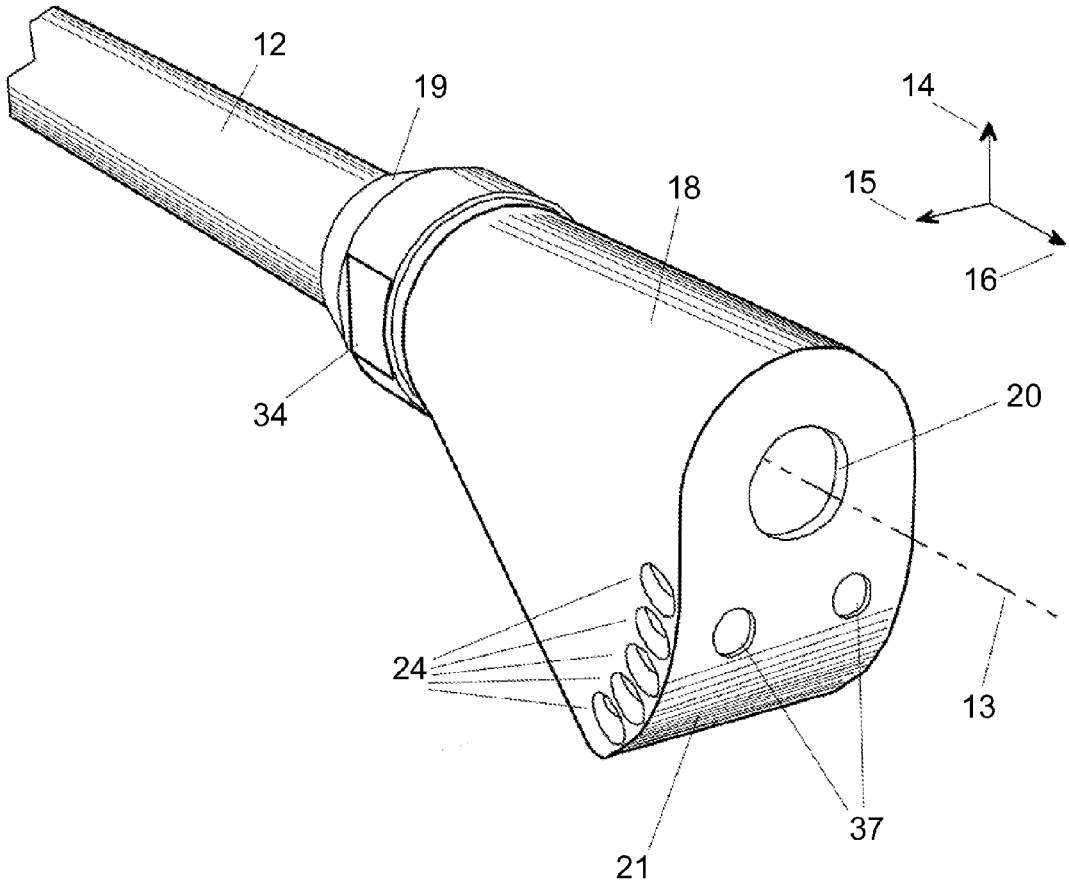
FIG. 9 shows an embodiment of the compensator in FIG. 1 modified with forward porting.

In FIG. 9, the embodiment of the compensator is identical to the features shown in FIG. 1 with the inclusion of exhaust ports that face longitudinally forward 37 and are positioned vertically beneath the departure recess on the curved thrust surface 21.

Figure 10:
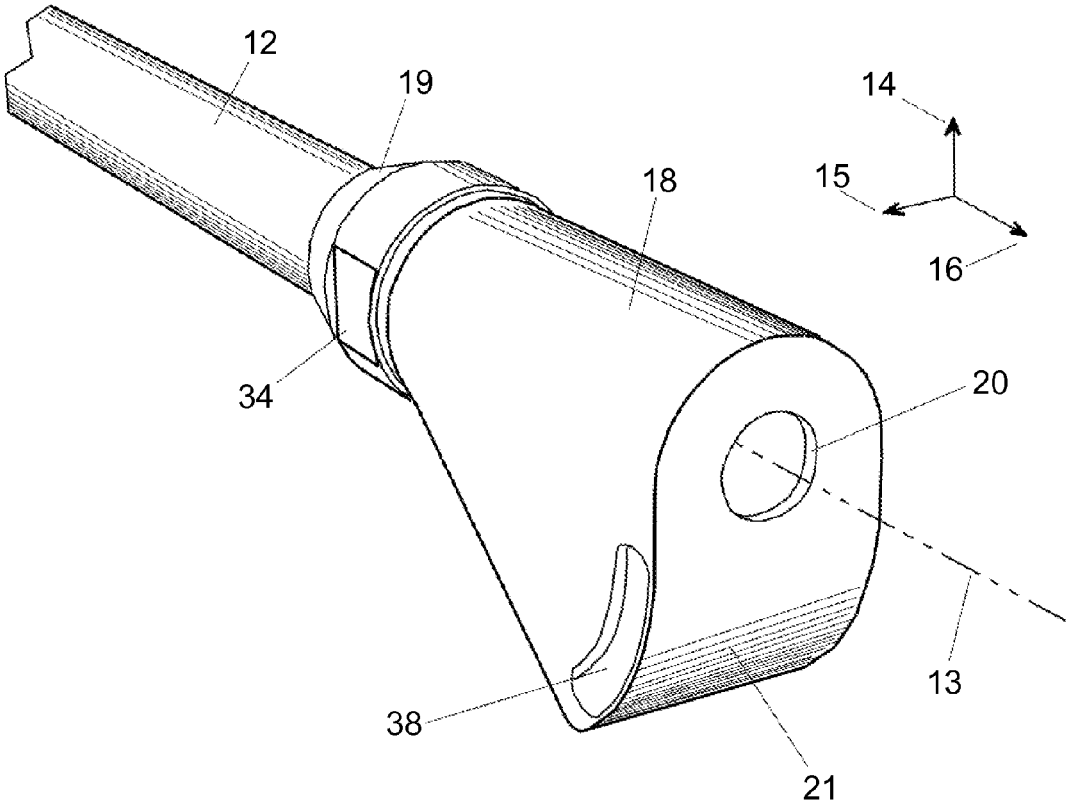
FIG. 10 shows an embodiment of the compensator in FIG. 1 modified with lateral slot ports.

Lastly in FIG. 10, the embodiment of the compensator is identical to the features shown in FIG. 1 with one modification. The exhaust ports seen in prior embodiments that are positioned on the lateral sides of the expansion chamber near the curved thrust surface 21 are replaced with slot ports 38 for increased exhaust porting.

Although the description above contains many specificities, these should not be construed as limiting the scope of embodiments but as merely providing illustrations of some of several embodiments. Thus, the scope of the embodiments should be determined by the appended claims and their legal equivalents, rather than by the examples given.

The invention claimed is:

1. A compensating apparatus configured to be affixed to a muzzle of a gun having a gun barrel, the apparatus comprising:

a muzzle engagement recess configured to be positioned coaxial to and longitudinally forward of said gun barrel;

an expansion chamber comprising:

a front wall;

a ceiling extending from the muzzle engagement recess to the front wall;

a curved thrust surface extending from the front wall and facing the muzzle;

a compression ramp extending longitudinally from the muzzle engagement recess to the curved thrust surface;

first and second lateral walls extending from the muzzle engagement recess to the front wall and from the ceiling to the compression ramp;

a departure recess defined in the front wall and positioned longitudinally forward of and coaxial to said gun barrel and said muzzle engagement recess; and a plurality of exhaust ports defined in the first and second lateral walls proximal to the curved thrust surface, wherein the expansion chamber defines an asymmetric internal volume expanding downward relative to the longitudinal axis of the gun barrel.

2. The compensating apparatus of claim 1, wherein said plurality of exhaust ports are defined vertically beneath said departure recess on the first and second lateral walls at a close proximity to said curved thrust surface.

3. The compensating apparatus of claim 1, wherein said expansion chamber further comprises a porous guide tube positioned on said longitudinal axis of said gun barrel bridging said muzzle engagement recess and said front wall.

4. The compensating apparatus of claim 1 wherein said departure recess has a serrated, gear-shaped pattern.

5. The compensating apparatus of claim 1, wherein said muzzle engagement recess is configured to engage said muzzle via threads on said gun barrel.

6. The compensating apparatus of claim 1, wherein said muzzle engagement recess is configured to engage said muzzle via accessory-mounting rails.

7. The compensating apparatus of claim 1, further comprising a plurality of accessory-mounting rails.

8. The compensating apparatus of claim 1, wherein said muzzle engagement recess further comprises a plurality of grooves configured to engage a quick-attach muzzle accessory affixed to said gun barrel.

9. The compensating apparatus of claim 1, wherein said first and second lateral side walls include a plurality of triangular ports.

10. The compensating apparatus of claim 1, wherein said curved thrust surface includes a plurality of indents facing said gun barrel.

11. The compensating apparatus of claim 1, wherein a portion of the total internal volume positioned vertically beneath the longitudinal axis of the gun barrel and longitudinally proximal to said muzzle departure recess is greater than a portion of the internal volume proximal to the muzzle engagement recess.

12. The compensating apparatus of claim 1, wherein the compression ramp is configured to guide exhaust gases emitting from the muzzle to the curved thrust surface.

13. A compensating apparatus configured to be affixed to a muzzle of a gun having a gun barrel, the apparatus comprising:

a muzzle engagement recess configured to be positioned coaxial to and longitudinally forward of said gun barrel;

an expansion chamber comprising:

a front wall;

a ceiling extending from the muzzle engagement recess to the front wall;

a curved thrust surface extending from the front wall and facing the muzzle engagement recess;

a compression ramp extending longitudinally from the muzzle engagement recess to the curved thrust surface;

generally planar first and second lateral walls extending from the muzzle engagement recess to the front wall and from the ceiling to the compression ramp;

a departure recess defined in the front wall and positioned longitudinally forward of and coaxial to said gun barrel and said muzzle engagement recess.

14. The compensating apparatus of claim 13, wherein the plurality of exhaust ports are positioned vertically beneath said departure recess on the first and second lateral walls.

15. The compensating apparatus of claim 13, wherein said expansion chamber further comprises a porous guide tube positioned on said axis of said gun barrel bridging said muzzle engagement recess and said front wall.

16. The compensating apparatus of claim 13, wherein said first and second lateral walls include a plurality of triangular ports.

17. The compensating apparatus of claim 13 wherein said departure recess has a serrated, gear-shaped pattern.

18. The compensating apparatus of claim 13, further comprising a plurality of exhaust ports defined in the first and second lateral walls, wherein the exhaust ports are aligned to one another along a curve generally parallel to a curve of the curved thrust surface and are proximal to the curved thrust surface.

19. A compensating apparatus for a gun having a barrel with a muzzle, the compensating apparatus comprising:

a muzzle engagement recess configured to be affixed to the muzzle;

an expansion chamber comprising:

a front wall;

a ceiling extending from the muzzle engagement recess to the front wall;

a curved thrust surface extending from the front wall and facing the muzzle;

a compression ramp extending longitudinally from the muzzle engagement recess to the curved thrust surface;

generally planar first and second lateral walls extending from the muzzle engagement recess to the front wall and from the ceiling to the compression ramp;

a departure recess defined in the front wall and positioned longitudinally forward of and coaxial to said gun barrel and said muzzle engagement recess; and first and second curved slot ports defined in the first and second lateral walls, respectively, extending along a curve parallel to a curve of the curved thrust surface.

* * * * *